US007151345B2

(12) United States Patent
Sanchez

(10) Patent No.: US 7,151,345 B2
(45) **Date of Patent: *Dec. 19, 2006**

(54) METHOD AND APPARATUS FOR CONTROLLING VISUAL ENHANCEMENT OF LUMINENT DEVICES

(75) Inventor: Jorge Sanchez, Poway, CA (US)

(73) Assignee: Ceyx Technologies, Inc., San Diego, CA (US)

( * ) Notice: Subject to any disclaimer, the term of this patent is extended or adjusted under 35 U.S.C. 154(b) by 5 days.

This patent is subject to a terminal disclaimer.

(21) Appl. No.: 10/984,441

(22) Filed: Nov. 8, 2004

(65) Prior Publication Data

US 2005/0099144 A1 May 12, 2005

Related U.S. Application Data

(63) Continuation of application No. PCT/US2004/03400, filed on Feb. 6, 2004.

(60) Provisional application No. 60/518,490, filed on Nov. 6, 2003, provisional application No. 60/445,914, filed on Feb. 6, 2003.

(51) Int. Cl.
*G05F 1/00* (2006.01)

(52) U.S. Cl. ..... 315/308; 315/224

(58) Field of Classification Search ..... 315/312, 315/314, 316, 318, 247, 308; 345/102, 207, 345/291, 225, 224, 324
See application file for complete search history.

(56) References Cited

U.S. PATENT DOCUMENTS 5,838,290 A * 11/1998 Kuijk ..... 345/91
6,344,641 B1 2/2002 Blalock et al. ..... 250/205
6,496,236 B1 * 12/2002 Cole et al. ..... 349/61
6,654,268 B1 * 11/2003 Choi ..... 363/134
6,717,374 B1 * 4/2004 Krummel ..... 315/291
6,812,916 B1 * 11/2004 Hwang ..... 345/102
6,922,023 B1 7/2005 Hsu et al. ..... 315/291

(Continued)

FOREIGN PATENT DOCUMENTS

EP 1 077 444 A 2/2001

(Continued)

OTHER PUBLICATIONS

White Paper for CEYX Technologies LCD Backlighting Control 'Online, published Mar. 30, 2005, pp. 1-5 XP002322704 Retrieved from the Internet: URL:http://www.ceyx.com/web/WhitepaperLCDBacklightingControl.pdf>' retrieved on Mar. 30, 2005!.

(Continued)

*Primary Examiner*—Hoanganh Le
*Assistant Examiner*—Tung Le
(74) *Attorney, Agent, or Firm*—Charles F. Reidelbach, Jr.

(57) ABSTRACT

The disclosed embodiments provide a method and apparatus for visual enhancement of liquid crystal displays. A microprocessor or embedded microcontroller associated with visual enhancement circuit modules allows a single inverter to control the intensity of illumination for an array of multiple CCFLs. The microcontroller continuously senses the operating currents of every lamp and adjusts for variations in illumination of individual lamps by parallel switching of capacitance that ensures an equal current is applied to each lamp. The microcontroller produces the appropriate control signals and executes a digital servo control algorithm to modify the currents for carrying out the luminance adjustments.

23 Claims, 7 Drawing Sheets

U.S. PATENT DOCUMENTS

| | | | | |
|---|---|---|---|---|
| 2002/0097004 | A1 | 7/2002 | Chiang et al. | 315/224 |
| 2003/0142060 | A1* | 7/2003 | Lee et al. | 345/102 |
| 2003/0201967 | A1* | 10/2003 | Yu | 345/102 |
| 2003/0227435 | A1* | 12/2003 | Hsieh | 345/102 |
| 2003/0234762 | A1* | 12/2003 | Nakatsuka et al. | 345/102 |
| 2004/0046512 | A1* | 3/2004 | Suzuki et al. | 315/291 |
| 2004/0068511 | A1 | 4/2004 | Sanchez | 707/100 |
| 2004/0207340 | A1 | 10/2004 | Huang | 315/291 |
| 2005/0078081 | A1* | 4/2005 | Oda et al. | 345/102 |
| 2005/0093484 | A1* | 5/2005 | Ball | 315/291 |

FOREIGN PATENT DOCUMENTS

| | | | |
|---|---|---|---|
| WO | WO 2004/026006 | A2 | 8/2003 |
| WO | WO 2004/072733 | A2 | 2/2004 |

OTHER PUBLICATIONS

International Search Authority for PCT/US2004/037504, date of mailing Jul. 18, 2005 and written opinion.

* cited by examiner

Figure 1 (PriorArt)

METHOD AND APPARATUS FOR CONTROLLING VISUAL ENHANCEMENT OF LUMINENT DEVICES

CROSS-REFERENCE TO RELATED APPLICATION

This application is a utility conversion of U.S. Provisional Application No. 60/518,490, filed Nov. 6, 2003, which is a continuation in part of co-pending PCT Application No. PCT/US2004/003400, having an international filing date of Feb. 6, 2004, which is a conversion of U.S. Provisional Application No. 60/445,914 with a filing date of Feb. 6, 2003.

BACKGROUND

1. Field

The presently disclosed embodiments relate generally to the control of light emitting devices such as Cold Cathode Fluorescent Lamps and Light Emitting Diodes. More specifically, the disclosed embodiments relate to controlling the backlighting of Liquid Crystal Displays.

2. Background

Cold Cathode Fluorescent Lamps (CCFLs) are now commonly used for backlighting Liquid Crystal Displays (LCDs) in notebook and laptop computer monitors, car navigation displays, point of sale terminals and medical equipment. The CCFL has quickly been adopted for use as the backlight in notebook computers, and various portable electronic devices because it provides superior illumination and cost efficiency. These applications generally require uniformity of display brightness and illumination intensity.

Typically, liquid crystal material, separated from a CCFL backlighting device by a diffuser layer, polarizes the light for each display pixel. A high voltage DC/AC inverter is required to drive the CCFL because this lamp uses a high Alternating Current (AC) operating voltage. With the increasing size of the LCD panel, multiple lamps are required to provide the necessary illumination. Therefore, an effective inverter is required to drive multiple CCFL arrays.

Intensity of illumination is determined by the operating current applied to the CCFL by an inverter. In conventional multiple lamp panel arrays, either each lamp must be driven by its own costly inverter, or one shared inverter sets the operating current of all the lamps to a current determined by a preset amount of total current for all the lamps.

However, each lamp varies in brightness and intensity due to age, replacement and inherent manufacturing variations. Applying the same reference current to each lamp, without adjusting for individual lamp variations, creates a different intensity of illumination for each lamp. Varying illumination intensities causes visible undiffused lines to be displayed. Conventional single inverter circuits cannot individually sense and adjust the operating current for each lamp in order to equalize the illumination intensity across multiple lamp array display panels.

As the market place has driven down the cost of CCFLs, resulting in widespread use of multiple lamp array display panels, the demand for inverter quality, economy and functionality has increased. Conventional types of backlights for LCD devices are not fully satisfactory in illumination intensity uniformity. Thus, there is a need in the art for an economical inverter capable of individually sensing and adjusting the current applied to an array of CCFLs in multiple lamp LCD displays.

SUMMARY

Embodiments disclosed herein address the above-stated needs by providing a method and apparatus for a visual enhancement control module having a single CCFL inverter capable of preserving individual current settings in multiple lamp arrays.

The visual enhancement control module uses a switching circuit comprising a rectifier bridge, a transistor switch and a microcontroller interface serially coupled to a CCFL circuit. Alternatively a switched capacitor circuit is serially coupled to a CCFL circuit. A microprocessor executes servo control system software for sensing current and illumination intensity feedback information used to drive a current control circuit. The system software monitors the current and voltage across the lamps and determines the capacitance required to obtain a specific amount of current in each lamp. A visual enhancement control module comprising a single inverter drives a multiple lamp array while retaining precise control of current, and hence intensity of illumination, in each lamp.

Accordingly, in one aspect, a method of current control for multiple luminent devices is disclosed. The method senses individual output information for each luminent device of a multiple device array and processes the output information to produce individual current control signals for each device. The current control signals are used for adjusting an operating current applied to each device through a single inverter in accord with the individual output information.

In another aspect, an apparatus for current control of multiple luminent devices is disclosed. The apparatus includes sensors for sensing individual output information for each luminent device of a multiple device array, a microcontroller for processing the output information to produce individual current control signals for each device, and a current equalization circuit and server control system software for adjusting an operating current applied to each device through a single inverter in accordance with the current control signals.

BRIEF DESCRIPTION OF THE DRAWINGS

The nature, objects, and advantages of the invention will become more apparent to those skilled in the art after considering the following detailed description in connection with the accompanying drawings, in which like reference numerals designate like parts throughout, and wherein.

DETAILED DESCRIPTION

The word "exemplary" is used exclusively herein to mean "serving as an example, instance, or illustration." Any embodiment described herein as "exemplary" is not necessarily to be construed as preferred or advantageous over other embodiments.

The disclosed embodiments provide a method and apparatus for visual enhancement of liquid crystal displays. A microprocessor or embedded microcontroller associated with visual enhancement circuit modules allows a single inverter to control the intensity of illumination for an array of multiple CCFLs. The microcontroller continuously senses the operating currents of every lamp and adjusts for variations in illumination of individual lamps by parallel switching of capacitance that ensures an equal current is applied to each lamp. The microcontroller produces the appropriate control signals and executes a digital servo control algorithm to modify the currents for carrying out the luminance adjustments.

Figure 1:
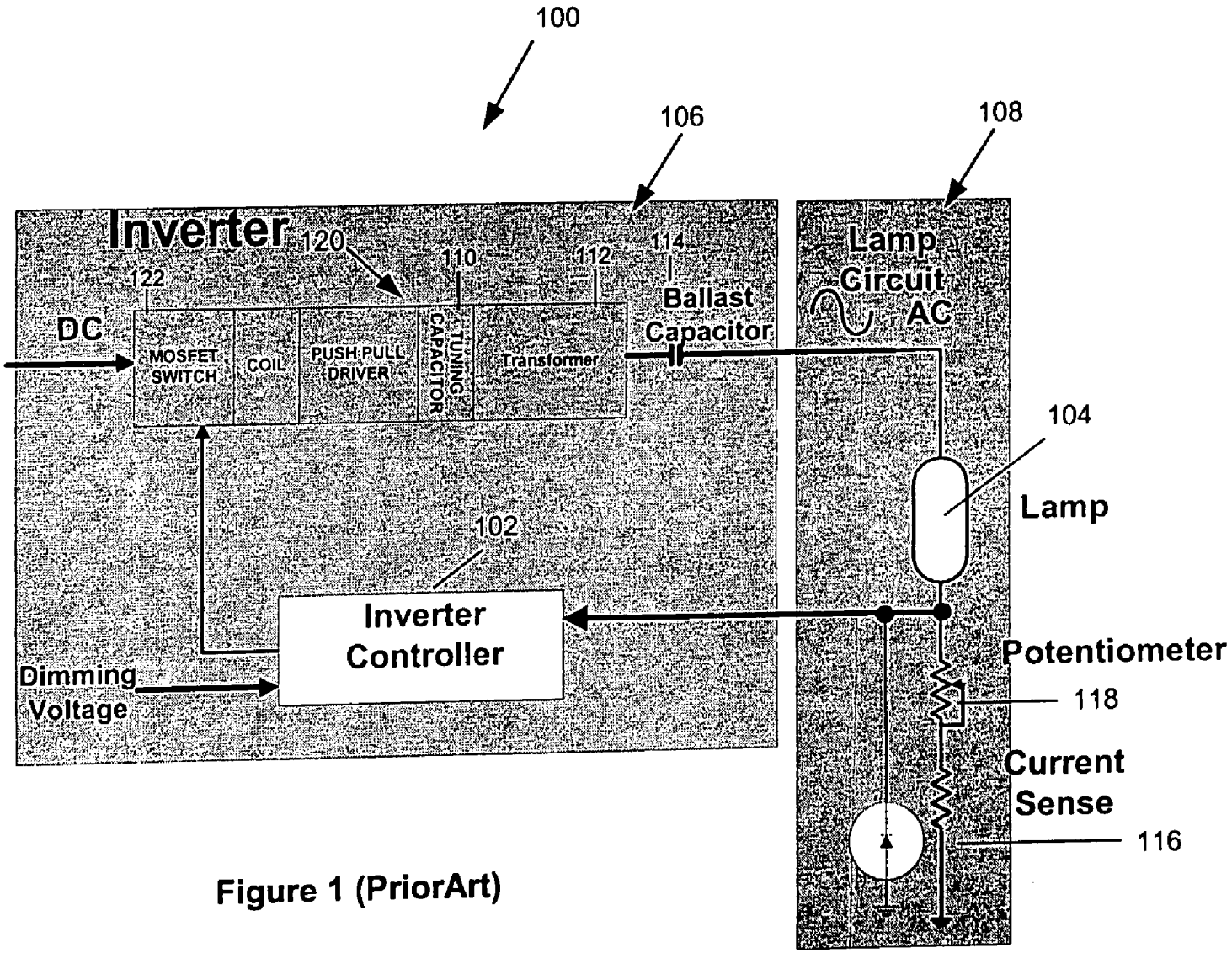
FIG. 1 shows a conventional inverter circuit for driving a single CCFL.

FIG. 1 illustrates a conventional CCFL control circuit 100 requiring an inverter 120 for each lamp 104 in an LCD backlight array. Fluorescent lamps 104 exhibit significant manufacturing variations. Lamps 104 are driven from an inverter control circuit 120, which contains a primary side circuit 106, and a secondary side circuit 108. The primary side circuit 106 manages high currents and low voltages and connects to the primary side of a transformer 112. The secondary side circuit 108 connects to the secondary of the transformer 112, a ballast capacitor 114, the fluorescent lamp 104, a current sensor 116 and a potentiometer 118 to adjust the lamp current.

If more than one lamp is driven out of the same inverter 120, due to the lamp variations, the current through each lamp will be different. As a result, the luminance across an LCD panel will be uneven. The portion of the inverter 120 that is directly connected to the lamp (secondary voltage of the transformer 112) is a high voltage circuit. Because of the magnitude of the voltages involved, the circuit 100 cannot be easily controlled in order to change the power applied to the lamp 104.

Conventional solutions resolve the problem by utilizing a separate inverter 120 for each lamp 104. Using a separate inverter 120 for each lamp 104 allows the adjustment of the current in the individual lamp with a potentiometer 118. The current sense signal is used to operate a switching circuit 122 in the inverter 120, which operates with low voltage (primary of transformer 112). The conventional solution is very costly because numerous inverters 120 are used for a given LCD display.

Figure 2:
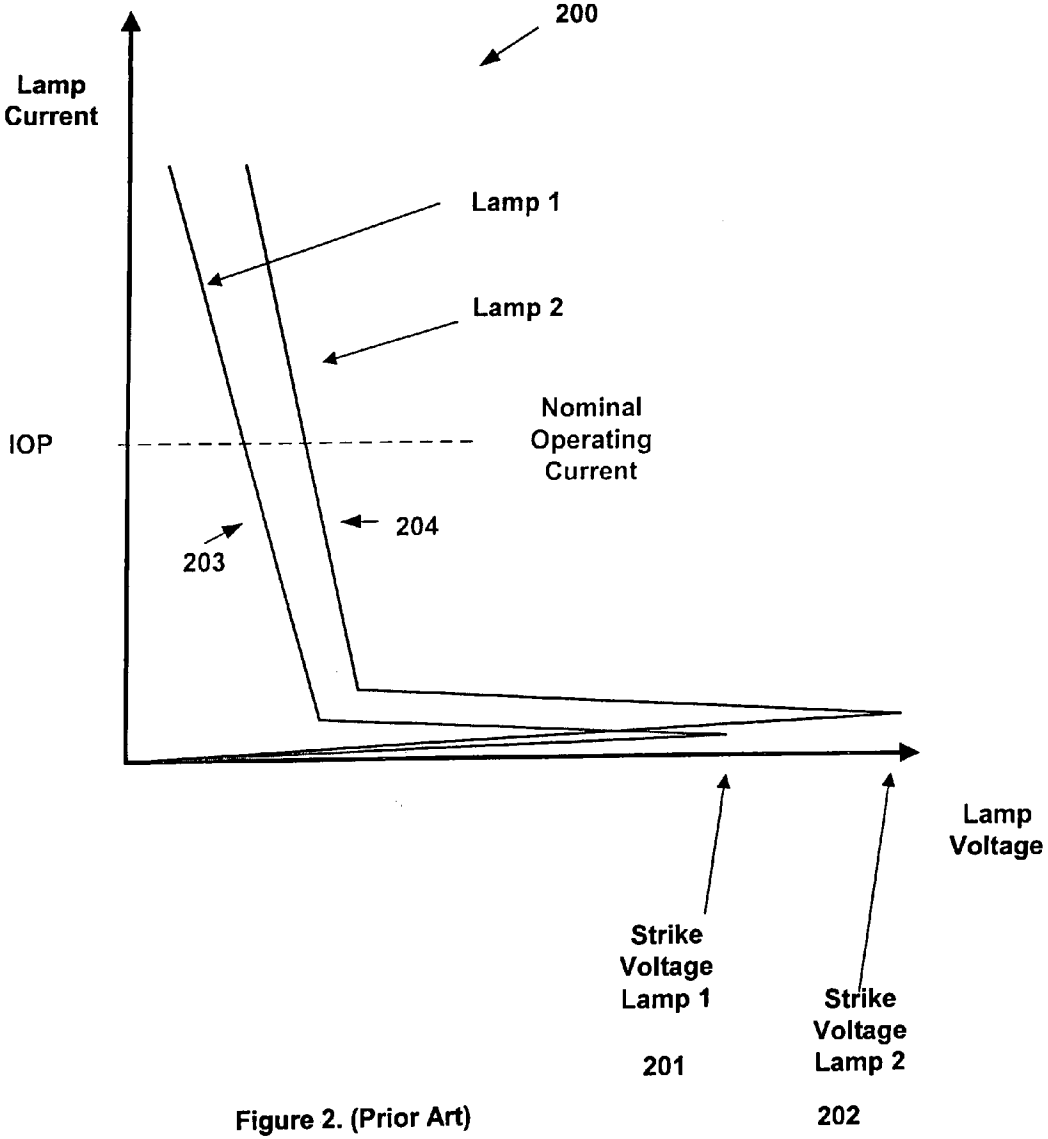
Figure 2. (Prior Art)
FIG. 2 illustrates conventional variations in characteristic current with respect to voltage for multiple CCFLs driven by conventional individual inverters.

In FIG. 2, variations in characteristic current with respect to voltage 200 for multiple CCFLs driven by the conventional control circuit illustrated in FIG. 1 are graphically shown. Each lamp requires a strike voltage (201, 202) to ionize the contained gas of the lamp and achieve a luminous output. After the lamp strikes, each lamp will exhibit a different voltage-current relationship as shown by their operating voltage slopes (203, 204).

Figure 3:
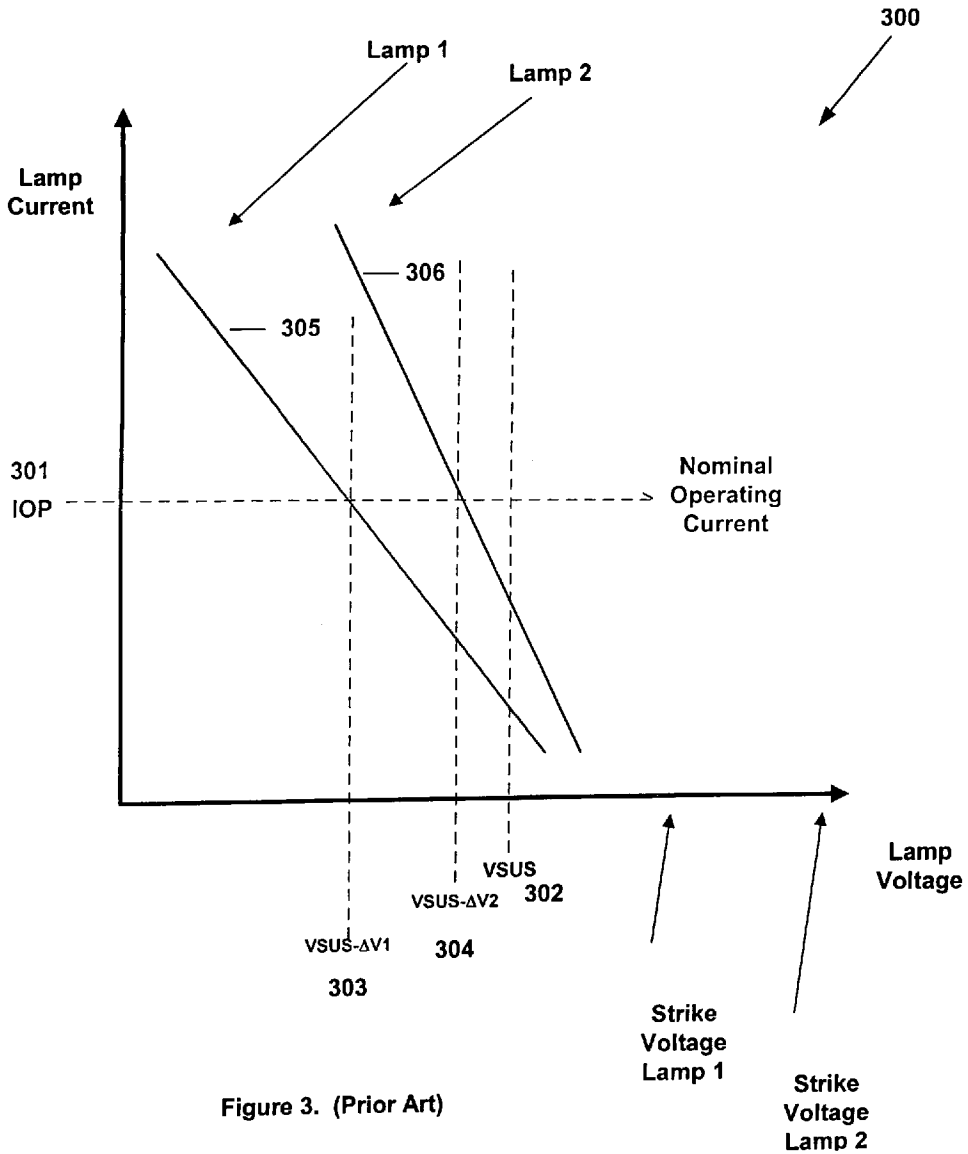
Figure 3. (Prior Art)
FIG. 3 illustrates conventional variations in characteristic current with respect to voltage for multiple CCFLs driven by a conventional shared inverter.

FIG. 3 shows conventional variations in characteristic current with respect to voltage when two CCFLs are driven from the same inverter. Each slope (305, 306) is different after its strike voltage has been attained. If a target lamp current equals a Nominal Operating Current of IOP 301, and the Nominal Sustaining Voltage equals VSUS 302, the voltage applied to lamp 1 must be reduced by a delta of V1 to obtain a voltage across lamp 1 of VSUS minus the delta of V1 303. Likewise, the voltage applied to Lamp 2 voltage must be reduced by a delta of V2 to obtain a voltage across lamp 2 of VSUS minus the delta of V2 304. The voltage reductions across the lamps will result in the same Nominal Operating Current of IOP for both lamps, which will produce a uniform intensity of illumination.

Figure 4:
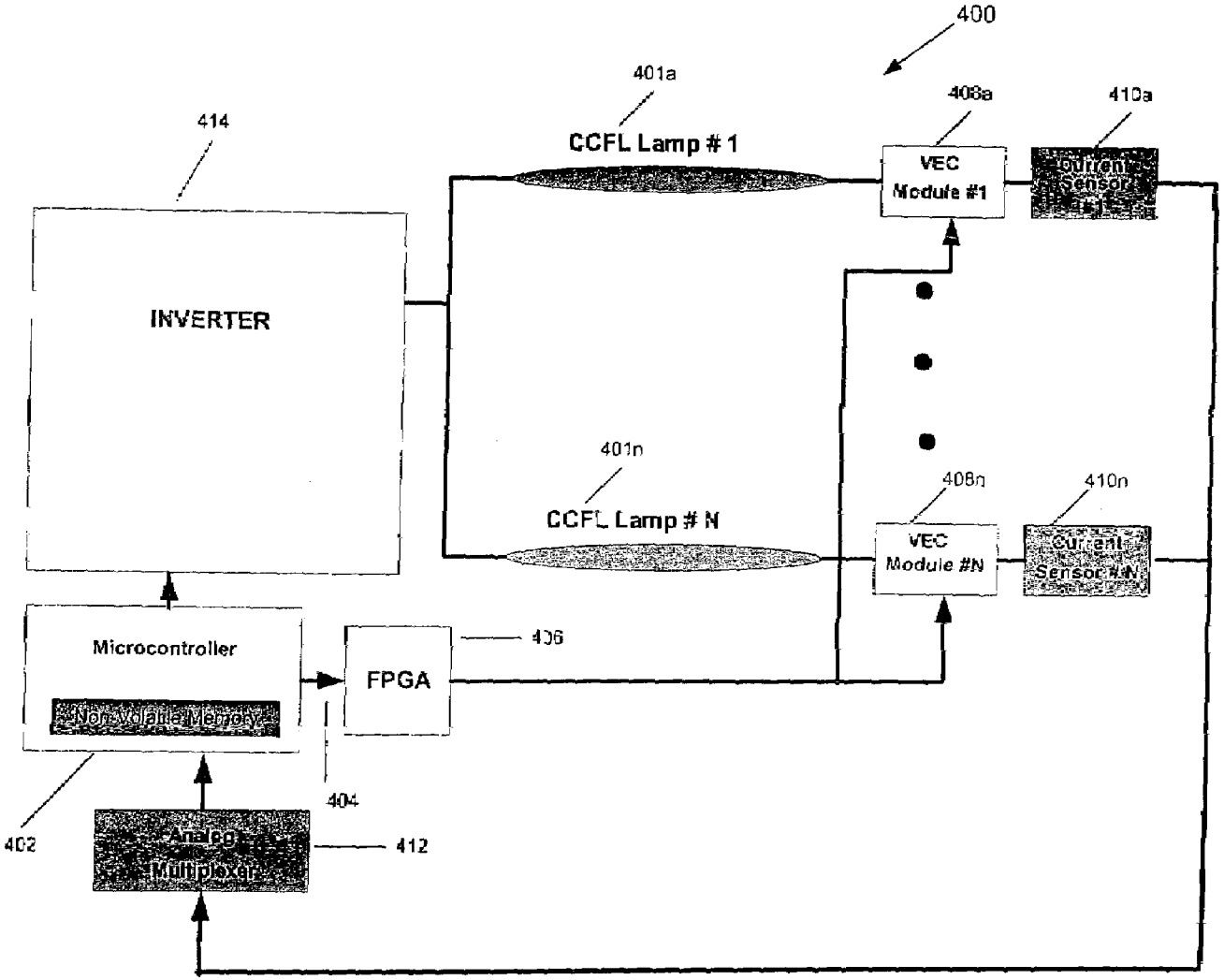
FIG. 4 illustrates a visual enhancement closed loop control system for multiple CCFLs in accordance with one embodiment of the present invention.

FIG. 4 is a block diagram illustrating a novel visual enhancement closed loop control system 400 for backlighting an array of N CCFLs 401 in accordance with one embodiment of the present invention.

A microcontroller 402 executes, from non-volatile memory, one or more software modules comprising program instructions that generate current control signals 402 for input to a Field Programmable Gate Array (FPGA) 406. A software module may reside in the microcontroller, RAM memory, flash memory, ROM memory, EPROM memory, EEPROM memory, registers, hard disk, a removable disk, a CD-ROM, or any other form of storage medium known in the art.

The FPGA 406 distributes the current control signals 404 to visual enhancement control modules 408 associated with individual CCFLs 401 as specified by the microcontroller 402. The visual enhancement control modules 408 (detailed in FIG. 6 and FIG. 7) drive each CCFL 401 with the amount of current specified by the microcontroller 402. Current sensors 410 continuously detect the actual individual lamp currents for feedback to the microcontroller 402. The individual lamp currents output by the current sensors 410 are multiplexed by analog multiplexer 412 for input to the microcontroller 402.

A servo control algorithm software module executed by the microcontroller 402 continuously utilizes the multiplexed feedback information provided by the current sensors 410 to adjust visual enhancement control module 408 settings. These setting adjustments maintain desired individual lamp currents by continuously compensating for current variations caused by age, replacement, inherent manufacturing variations and changes in temperature. Software modules executed by the microcontroller 402 concurrently control and adjust the operation of an inverter 414 that controls the secondary voltage output of the inverter 414 (See FIG. 1, element 112). The secondary voltage output of the inverter 414 is applied to the CCFLs 401.

In various embodiments, any combination of microcontrollers 402, inverters 414, memory, FPGAs 406, multiplexers 412, current sensors 410 and control modules 408 may be integrated on a Printed Circuit (PC) board or in an Application Specific Integrated Circuit (ASIC). Alternately, the microcontroller 402, FPGA 406 and Multiplexer 412 may be integrated with the inverter assembly 414. The microcontroller 402, FPGA 406 functionality and the multiplexer 412 may also be integrated in the same, or another, single Integrated Circuit (IC). Additionally, one or more visual enhancement control modules 408 may be integrated in a single IC, which may also comprise current sensors 410 or light sensors (See FIG. 5, element 510).

A Graphical User Interface supported by one or more software modules executed by the microcontroller 402 may be used to perform initial current settings or optionally, to later override servo control algorithm maintenance settings.

Figure 5:
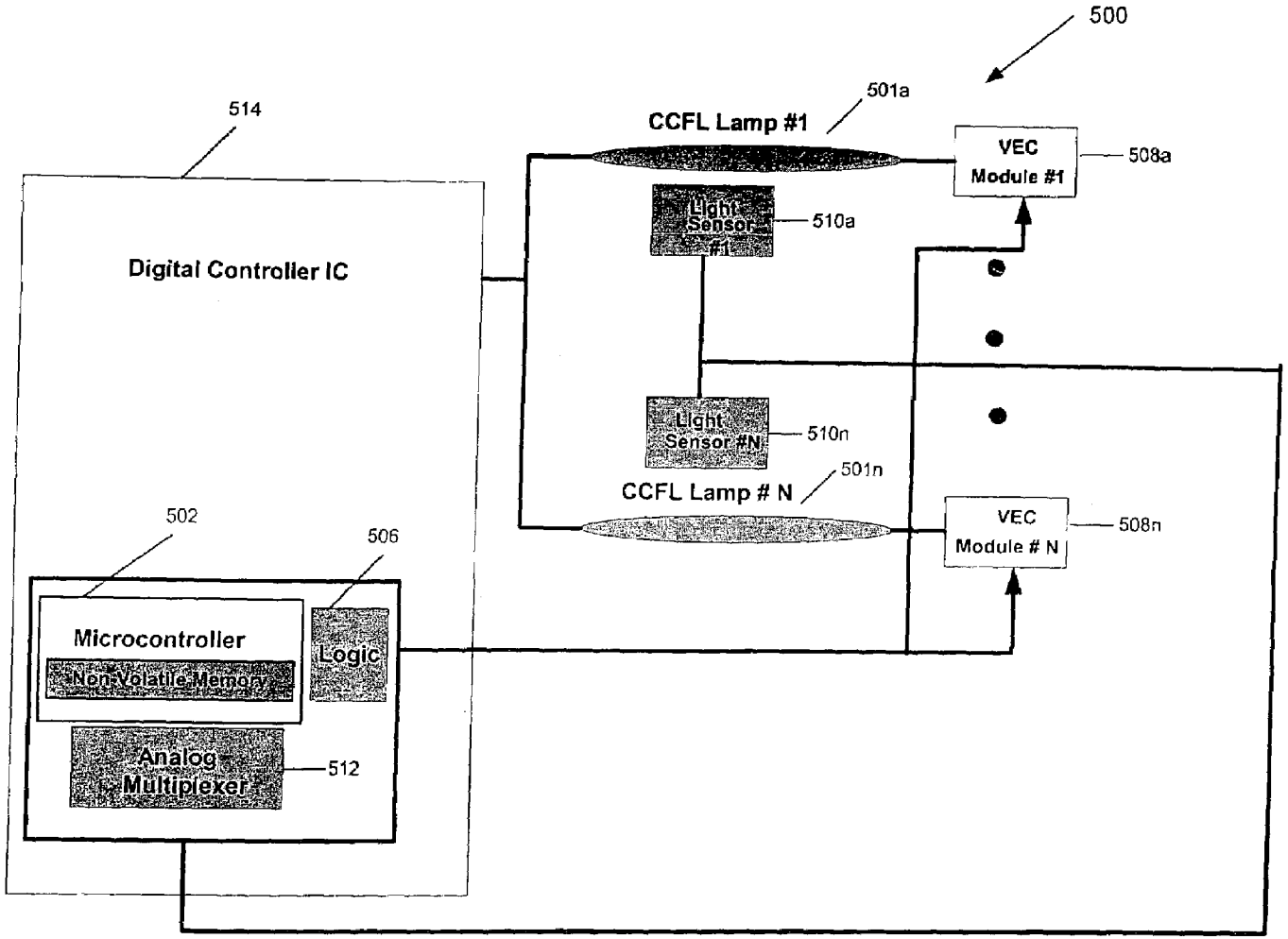
FIG. 5 illustrates a visual enhancement control system for multiple CCFLs in accordance with another embodiment of the present invention.

FIG. 5 illustrates a visual enhancement control system for multiple CCFLs in accordance with another embodiment of the present invention. The alternative visual enhancement control system 500 embodied in FIG. 5 utilizes one or more light sensors 510 rather than current sensors (See FIG. 4, element 410) to provide feedback information to the microcontroller 502. A servo control algorithm software module executed by the microcontroller 502 continuously utilizes multiplexed feedback information provided by the light sensors 510 to adjust the visual enhancement control module settings. These setting adjustments maintain desired individual levels of luminance by continuously compensating for variations caused by age, replacement, inherent manufacturing variations and changes in temperature.

As detailed in FIG. 5, visual enhancement control modules 508 set the current in the CCFLs 501. The amount of current applied to each CCFL 501 through its associated visual enhancement control module 508 is determined by control signals from logic block 506. Logic block 506 performs the equivalent functionality of a FPGA (See FIG. 4, element 406.) The logic block 506, the microcontroller 502 and the analog multiplexer 512 may be components of a single integrated digital controller circuit.

Feedback to the visual enhancement closed loop control system 500 is provided by one or more light sensors 510. The light sensors 510 detect the amount of light output by the CCFLs 501. The light sensors 510 produce light output feedback signals for input to an analog multiplexer 512. The analog multiplexer 512 routes the light sensor feedback signals to an analog to digital (A/D) converter, which may be embedded in the microcontroller 502. A closed loop servo control algorithm software module executed by the microcontroller 502 continuously maintains a predetermined luminance set point for each CCFL 501. As CCFLs 501 age, output precision is advantageously improved by determining luminance output levels with light sensors 510.

In addition to preserving individual current settings in multiple lamp arrays for uniformity of luminosity, the above disclosed embodiments of a visual enhancement control system may also operate to produce visual effects in backlit luminent devices. The visual enhancement control system may be used to increase or decrease luminosity in selected portions of a display. For example, three dimensional effects can be created for video material comprising an explosion by increasing the light output level of portions of the display where the explosion occurs. Similarly, visual effects can be created for material enhanced by shadows such as scenes of a dark alleyway. Visual effects can be created by the disclosed control system using software modules that vary the amount of light output from a backlighting device in specific areas of a display.

Figure 6:
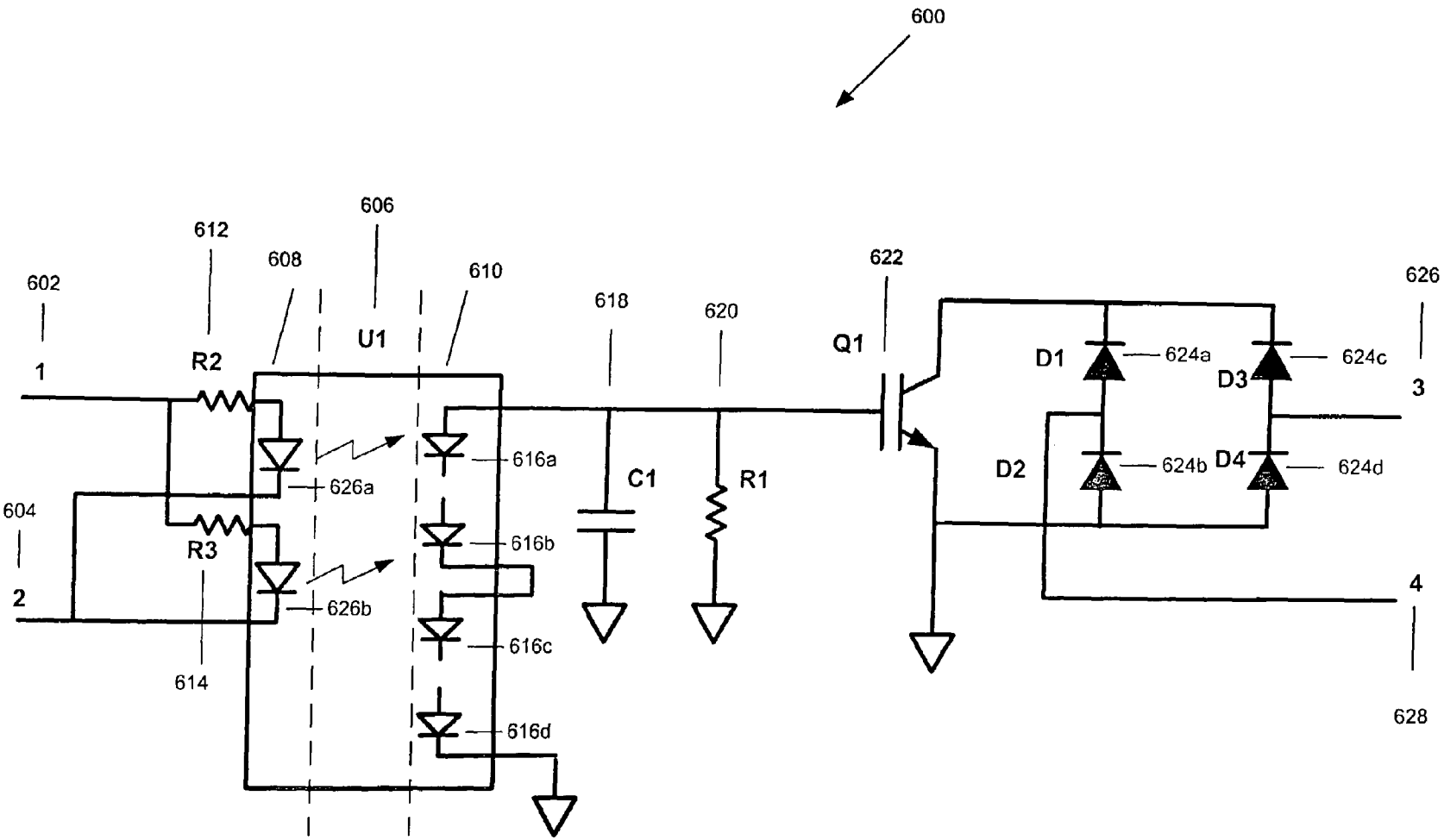
FIG. 6 shows a visual enhancement control module in accordance with one embodiment of the present invention; and, FIG. 7 shows a visual enhancement control module in accordance with another embodiment of the present invention.

FIG. 6 details the visual enhancement control modules illustrated in the system block diagrams of FIG. 4 and FIG. 5 in accordance with one embodiment of the present invention. The visual enhancement control module 600 adjusts the current applied to an individual CCFL according to control signals externally generated by a microcontroller (not shown). Inputs 1 602 and 2 604 receive a current control signal routed from a microcontroller by a system controller FPGA or Logic Block (not shown). The control signal may comprise a Direct Current (DC) voltage, or a Pulse Width Modulated (PWM) signal. The value of the control signal determines the amount of current through each CCFL in a multiple lamp array.

The control signals are applied to U1 606, an optical or photovoltaic device for converting the control signal to an isolated control voltage. Resistors R2 612 and R3 614 set a specified current in U1 606 proportional to the applied control signal. An optical isolator transfers the control signal to a secondary side of U1 610.

Where U1 is a photovoltaic inverter, light produced by output LEDs 626 in U1 will be converted to a voltage by the secondary side of U1 610. Capacitor C1 618 filters the output of U1 to produce an isolated control signal compatible with transistor Q1 622. Resistor R1 620 sets the impedance at the base of Q1 622 to a value that enables stable operation of Q1 622. Transistor Q1 622 may operate in a switch mode or in a linear mode as required by the CCFL current response. A current control bridge comprised of diodes D1–D4 624 routes both polarities of Alternating Current (AC) through Q1 622 to drive the CCFL.

In this manner, the received current control signal is converted to a proportional light output that is converted to a voltage, which generates a current specified by the control signal. The current specified by the control signal is output to a CCFL.

Figure 7:
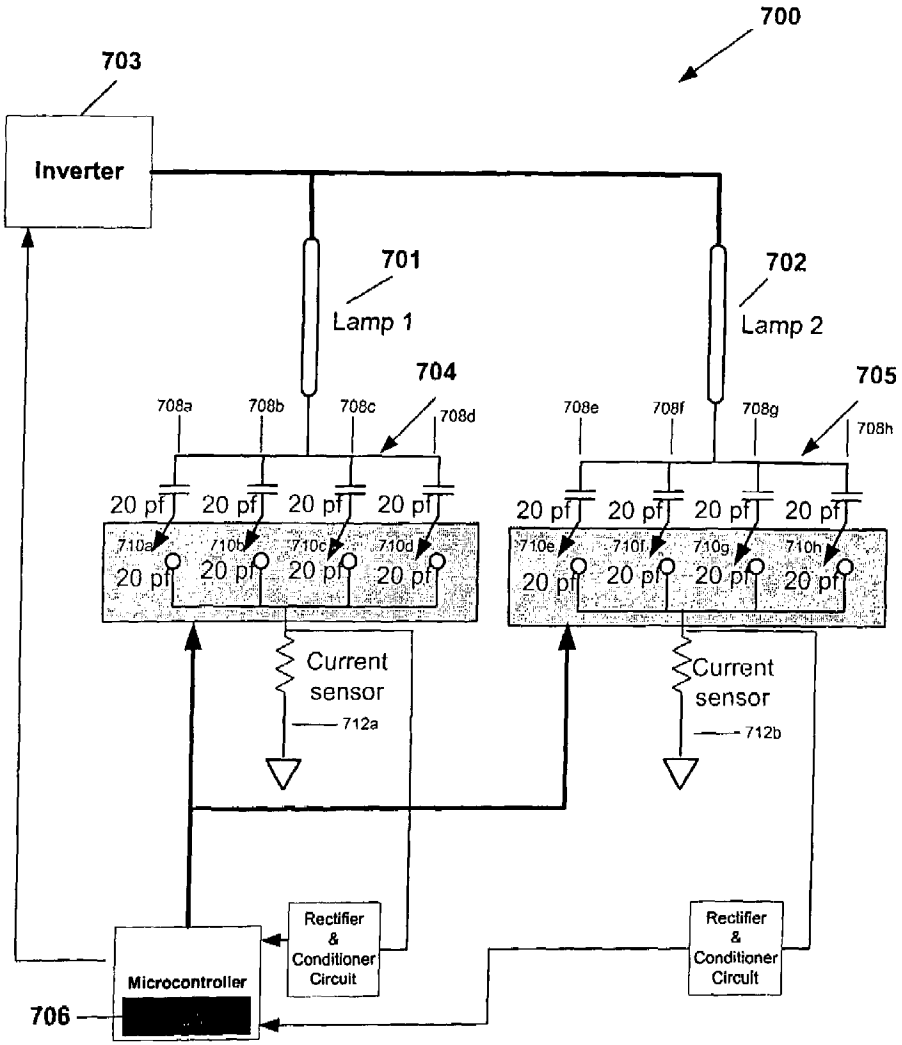

FIG. 7 details the visual enhancement control modules illustrated in the system block diagrams of FIG. 4 and FIG. 5 in accordance with another embodiment of the present invention. In the alternative visual enhancement control module 700 embodied in FIG. 7, two or more CCFLs (701, 702) are again driven by a single inverter 703. For simplicity, two exemplary CCFLs are shown. The visual enhancement control module 700 comprises a current control circuit 704 for CCFL 1 701 and a current control circuit 705 for CCFL 2 702. The control circuits (704, 705) are comprised of a plurality of parallel capacitors 708 coupled by switches 710. A microprocessor 706 controls inverter 703. Other values of capacitors 708 may be used to vary the current control effect.

Design difficulties are created by very small values of capacitance required by CCFLs. The controller of the present invention (704, 705) overcomes these capacitance design difficulties by providing a microcontroller 706 for execution of a calibration algorithm stored in non-volatile memory. The microcontroller executes a calibration procedure, which measures the current through each CCFL (701, 702) with current sensors 712 and an A/D inverter that may be internal to the microcontroller 706. The microcontroller 706 then closes the appropriate switches 710 in order to obtain the correct combination of capacitors that increases or reduces the lamp voltage by an appropriate amount.

Additional design difficulties are presented by the high voltages required by CCFLs. Theses difficulties are likewise overcome by the current control circuit of the present invention (704, 705) because the control circuits (704, 705) only require a voltage nominal enough to modify a CCFL (701, 702) operating point.

Because the slopes of the lamp characteristics after strike are very steep, the voltage across the controller must only be a few hundred volts. (See FIG. 2 and FIG. 3.) The voltages are easily handled with readily available capacitor and switch technology (see for example Supertex Inc. for high voltage switches, part number HV20220). The microcontroller may also use PWM for the controls that open and close the switches 710. The PWM duty cycle determines the exact value of capacitance. This approach allows for additional fine-tuning of the capacitor values.

The disclosed visual enhancement control system using the disclosed visual control enhancement modules provides a CCFL control circuit that is highly optimized in cost and performance. All CCFLs in an array can be made to exhibit equal (or a specified) luminance and current while driven by the same inverter.

One skilled in the art will understand that the ordering of steps and components illustrated in the figures above is not limiting. The methods and components are readily amended by omission or re-ordering of the steps and components illustrated without departing from the scope of the disclosed embodiments.

Thus, a novel and improved method and apparatus for controlling luminent devices generally, and cold cathode fluorescent lamps in particular, have been described. Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. In the alternative, the processor and the storage medium may reside as discrete components.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method of current control comprising:

supplying a drive current to a multiple device array from only one drive current source;

sensing a value of operating current from each device of the multiple device array; and reducing the operating current of each device in the multiple device array independently from variation in the operating current of every other device in the multiple device array in response to the sensed value of operating current by switching a combination of capacitors to reduce the drive current.

2. The method of claim 1 further comprising including an inverter as the drive current source and cold cathode fluorescent lamps as the multiple device array.

3. The method of claim 1 further comprising including a driver as the drive current source and light emitting diodes as the multiple device array.

4. An apparatus for current control comprising:

only one drive current source for supplying a drive current to a multiple device array;

sensors for sensing a value of operating current from each device of the multiple device array;

a microcontroller for receiving the sensed value of operating current and for generating a current control signal for each device of the multiple device array; and a current control circuit for reducing the operating current of each device in the multiple device array independently from variation in the operating current of every other device in the multiple device array in response to the current control signal by switching a combination of capacitors to reduce the drive current.

5. The apparatus of claim 4 further comprising an inverter as the drive current source and cold cathode fluorescent lamps as the multiple device array.

6. The apparatus of claim 4 further comprising a driver as the drive current source and light emitting diodes as the multiple device array.

7. A method for controlling intensity of illumination of a device comprising:

receiving a current control signal from a microcontroller;

generating a voltage control signal that is isolated from the current control signal;

filtering the voltage control signal to produce a filtered voltage control signal;

applying the filtered voltage control signal to a transistor to limit an alternating current in response to the current control signal; and conducting both polarities of the alternating current from a diode bridge through the transistor to control intensity of illumination of a device.

8. The method of claim 7 further comprising operating the transistor in linear mode.

9. The method of claim 7 further comprising operating the transistor in switched mode.

10. The method of claim 7 further comprising including cold cathode fluorescent lamps as the multiple device array.

11. A circuit for controlling intensity of illumination comprising:

an isolator for receiving a current control signal from a microcontroller and for generating an isolated voltage control signal from the current control signal;

a filter for filtering the voltage control signal to produce a filtered voltage control signal;

a transistor for limiting an alternating current in response to the filtered voltage control signal; and a diode bridge for conducting both polarities of the alternating current through the transistor to a device.

12. The circuit of claim 11 further comprising an optical isolator as the isolator.

13. The circuit of claim 11 further comprising a photovoltaic converter as the isolator to convert the current control signal to a proportional light output and to convert the proportional light output to the isolated voltage control signal.

14. A method for controlling intensity of illumination comprising:

supplying a drive current to a multiple device array from a single power source;

sensing a value of operating current from each device in the multiple device array;

generating a separate current control signal from the sensed value of operating current for each device in the multiple device array; and applying the current control signal to a plurality of switches coupled to each device in the multiple device array to reduce the operating current of each device in the multiple device array independently from variation in the operating current of every other device in the multiple device array in response to the current control signal by reducing the drive current.

15. The method of clam 14 further comprising including a cold cathode fluorescent lamp as each device in the multiple device array.

16. The method of claim 14 further comprising including a light emitting diode as each device in the multiple device array.

17. A circuit for controlling intensity of illumination comprising:

a single power source for supplying a drive current to a multiple device array;

sensors for sensing a value of operating current from each device in the multiple device array;

a microcontroller for receiving the value of operating current and for generating a separate current control signal from the sensed value of operating current for each device in the multiple device array; and switches coupled to each device in the multiple device array for reducing the operating current of each device in the multiple device array independently from variation in the operating current of every other device in the multiple device array in response to the current control signal by reducing the drive current.

18. The circuit of claim 17 further comprising a cold cathode fluorescent lamp as each device in the multiple device array.

19. The circuit of claim 17 further comprising a light emitting diode as each device in the multiple device array.

20. The circuit of claim 17 further comprising a backlight for a liquid crystal display as the multiple device array.

21. The circuit of claim 17 further comprising a software module executed by the microcontroller for maintaining a predetermined luminance set point for each device in the multiple device array.

22. The circuit of claim 17 further comprising a software module executed by the microcontroller for varying light output of a selected portion of the multiple device array to create visual effects.

23. The circuit of claim 17 further comprising a software module executed by the microcontroller for supporting a graphical user interface to perform initial current settings and to override servo control algorithm maintenance settings.

* * * * *

UNITED STATES PATENT AND TRADEMARK OFFICE

CERTIFICATE OF CORRECTION

PATENT NO. : 7,151,345 B2
APPLICATION NO. : 10/984441
DATED : December 19, 2006
INVENTOR(S) : Jorge Sanchez It is certified that error appears in the above-identified patent and that said Letters Patent is hereby corrected as shown below:

On the Title Page:

In the Related U.S. Application Data, add

Provisional Application No. 60/445,914 filed on Feb. 6, 2003

In the specification of the patent:

Column 1, in the CROSS-REFERENCE TO RELATED APPLICATION data, remove

"CROSS-REFERENCE TO RELATED APPLICATION
[1001] This application is a utility conversion of U.S. Provisional Application No. 60/518,490 filed November 6, 2003, which is a continuation in part of co-pending PCT Application No. PCT/US04/003400, having an international filing date of February 6, 2004, which is a conversion of U.S. Provisional Application No. 60/445,914 with a filing date of February 6, 2003."

and replace with

--CROSS REFERENCE TO RELATED APPLICATIONS
[1001] This application is a utility conversion of US Provisional Application No. 60/518,490, filed November 6, 2003, and is also a continuation in part of co-pending PCT Application No. PCT/US2004/003400 having an international filing date of February 6, 2004, which in turn is a conversion of US Provisional Application No. 60/445,914 with a filing date of February 6, 2003.--

Signed and Sealed this

Fourteenth Day of October, 2008

JON W. DUDAS
*Director of the United States Patent and Trademark Office*